United States Patent [19]

Cook

[11] 4,084,776

[45] Apr. 18, 1978

[54] FURNITURE BASE AND METHOD OF MAKING THE SAME

[75] Inventor: Donald W. Cook, Telford, Pa.

[73] Assignee: Cook Specialty Company, Green Lane, Pa.

[21] Appl. No.: 651,320

[22] Filed: Jan. 21, 1976

[51] Int. Cl.[2] ..... F16M 11/20

[52] U.S. Cl. ..... 248/188.7; 403/175

[58] Field of Search ..... 248/163, 440, 188, 188.1, 248/188.2, 188.7, 221; 403/172, 175, 217

[56] References Cited

U.S. PATENT DOCUMENTS

| | | | |
|---|---|---|---|
| 1,630,492 | 5/1927 | Kusterle | 403/217 |
| 2,044,021 | 6/1936 | Schachtel | 248/188.7 |
| 2,470,397 | 5/1949 | Harter | 248/188.7 |
| 3,236,485 | 2/1966 | Staples | 248/188.7 X |
| 3,286,964 | 11/1966 | McMahan et al. | 248/188.7 |
| 3,286,966 | 11/1966 | Botkin | 248/188.7 |
| 3,443,782 | 5/1969 | Fields et al. | 248/188.7 |
| 3,664,623 | 5/1972 | Svenson | 248/188.7 |
| 3,682,425 | 8/1972 | Vincent et al. | 248/188.7 |
| 3,801,054 | 4/1974 | Glowacki | 248/188.7 |

FOREIGN PATENT DOCUMENTS

| | | | |
|---|---|---|---|
| 480,044 | 12/1969 | Switzerland | 248/188 |
| 1,022,883 | 3/1966 | United Kingdom | 248/188.1 |

*Primary Examiner*—Lawrence J. Staab
*Attorney, Agent, or Firm*—Synnestvedt & Lechner

[57] ABSTRACT

A furniture base comprising a central vertical element, at least two radiating leg elements, and a spider element comprising at least one radiating member for each leg element. The spider element is secured near the bottom of the vertical element and the leg elements are secured in a radial fashion to the spider element and to the vertical element.

13 Claims, 8 Drawing Figures

FURNITURE BASE AND METHOD OF MAKING THE SAME

FIELD OF THE INVENTION

This invention relates to a supporting metal base structure, particularly adapted for use as a base of the type commonly employed in office chairs. More particularly the invention relates to a novel base construction which is of lighter weight, is of high durability and of simplified construction as compared with known prior designs.

BACKGROUND OF THE INVENTION

Various metallic pedestal bases of the kind having support legs radiating from a central column or pedestal have been employed in the past for the support of modern office chairs and other pieces of furniture suitable for office and home alike. While such bases are very popular because of their aesthetic qualities and durability, good chairs using such bases tend to be expensive, are often relatively heavy and consequently, are rather awkward to move around. A problem which contributes to the above arises because of the difficulty in securely fastening the radiating legs to the central pedestal or post on which the chair sits. When a welded construction is employed, as is customary with prior designs, the welded joints between the central post and the radiating legs are highly stressed and prone to failure, particularly when heavy loads are applied, for example, when an individual sits in the chair. The joint between the bottom edge portion of a leg element and the vertical post is of particular concern because this joint is subject to the highest tensile stress when the chair is loaded. Because of this, extra care must be taken to insure that good strong welds are made. The steel leg elements and the central column are necessarily made of extra heavy gauge material in order to sustain the stresses and to prevent flexure and deformation of the metal in the area of the welded joints.

It can be imagined that the extra labor necessary to accomplish the above and the relatively heavy materials required, contribute substantially to the cost of the chair base.

Another problem which arises with bases of the kind described is that the substantial amount of welding necessary produces scaling and discoloration near the welded joints. As a result, it is not possible to use preplated parts. Once bases of this kind have been assembled and welded, they must be carefully cleaned to remove scaling and discoloration prior to painting or coating. Although a certain amount of discoloration and unsightly welded joints may be hidden cosmetically as by means of an exterior shell as shown in U.S. Pat. No. 3,186,669, it is desirable as much as possible to eliminate the need for exterior masking in order to reduce material and labor costs.

Other prior patents of which I am aware of relating to the art of chair bases are U.S. Pat. Nos. 492,554, 2,218,583, 2,470,397, 3,186,064 and 3,186,669.

SUMMARY AND OBJECTS

One object of the present invention is to increase the load capability of a chair base by providing a means of relieving and redistributing the tensile and other stresses which ordinarily exist at radiating leg elements and the vertical columnar support.

Another object is a reduction of the amount of material required in various structural parts of a chair base without sacrificing the ability of the parts to sustain loads expected to be imposed upon the base.

Still another object is the provision of a base which is pleasing in appearance without the need for excessive cosmetic treatment to mask the weld joints.

Another important object is the provision of assembly techniques and construction which substantially eliminates scaling and discoloration thereby facilitating the use of preplated parts and simplifies coating and painting.

In accordance with the present invention, the above and other objects are achieved by furniture base for chairs and the like and to a manufacturing method wherein the base comprises a central vertical column, at least two leg elements radiating from the column, a spider element comprising at least one radiating member for interconnecting each leg element to the base. In accordance with the invention, the spider carries much of the load originally imposed on the weld joints and redistributes this load into the legs in a manner which avoids weld joint failure.

In the preferred embodiment, the furniture base comprises a vertical cylindrical tube to which a spider element is secured near the bottom. The spider element comprises an annular portion and four radiating members, the end portion of the radiating members being bent downwardly. Four leg elements with a rectangular cross-section are secured to the cylindrical tube by welding at the top edge portion and the bottom edge portion of the rectangular leg element. The leg element is secured to the spider element by a weld between the bottom edge portion of the leg element and the annular portion of the spider element and between a slot in the bottom wall of the leg element between the bent edge portion of the spider member which is fitted into the slot.

The furniture base of this invention has a number of advantages over heretofore available bases. The furniture base is capable of withstanding greater loads while utilizing less material. The spider of the present invention is particularly suited to reduce the tension on the joint between the bottom edge portion of the leg element and the vertical element while allowing the use of lighter gauge leg elements. The present invention provides a furniture base which is durable and pleasing in appearance while sharply reducing the amount of material and the time and labor costs involved in making the base. Other objects and advantages of this invention will be apparent in the following description of an illustrative embodiment of the invention.

DETAILED DESCRIPTION OF THE INVENTION

Figure 1:
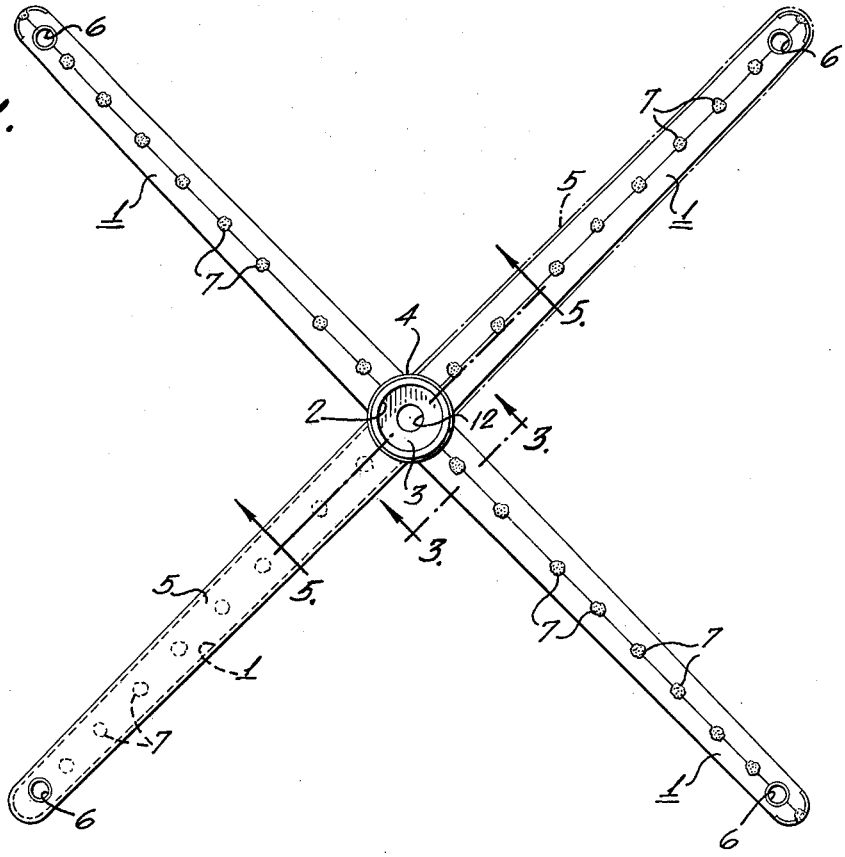
FIG. 1 is a plan view of a base incorporating the principles of the invention.
Figure 2:
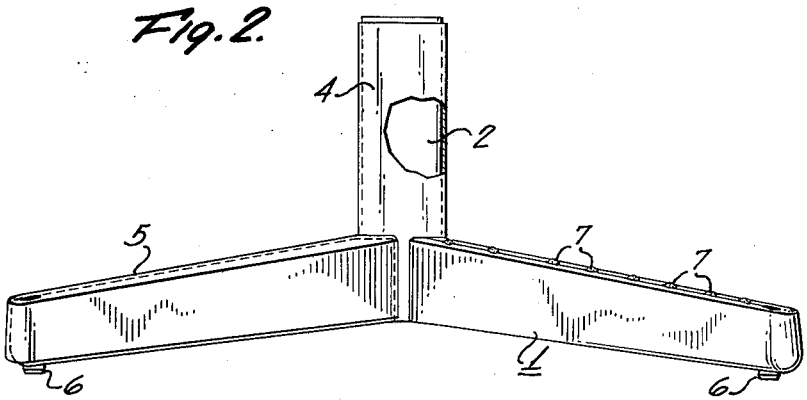
FIG. 2 is a side view of the base shown in FIG. 1.

As shown in the drawings, the preferred embodiment of the furniture base of this invention generally comprises a vertical element 2, four hollow leg elements 1, and a spider element 3. The spider element is secured near the bottom of the vertical element and the leg elements are secured in a radial fashion to the spider element and to the vertical element.

Figure 7:
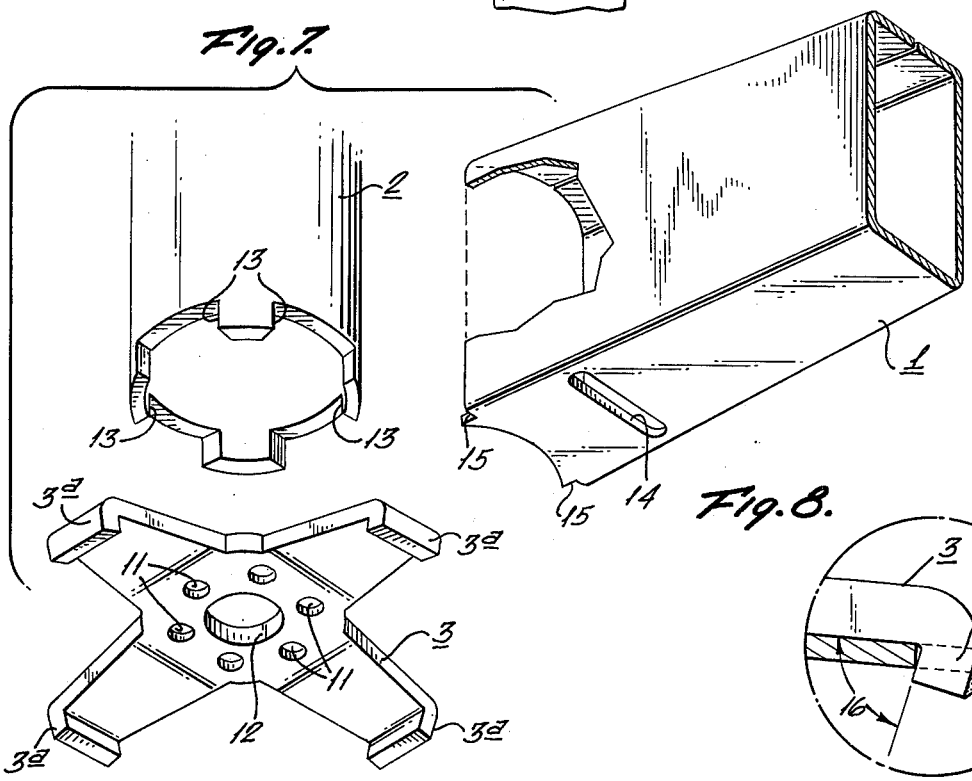
FIG. 7 is an exploded view of the base of FIG. 1.

The spider element 3 comprises a center portion which fits within vertical element 2 and at least one radiating member for each leg element. In the preferred embodiment, the spider element comprises an annular center portion and four radiating members. The vertical element 2 is typically a cylindrical tube of fixed length. In order to secure the spider element near the bottom of the cylindrical tube, the bottom of the tube has notches 13 opening downwardly and shaped and spaced to provide for the insertion and close fitting of the annular center portion of the spider element within the circumference of the tube and the radiating members of the spider within the notches 13 as shown in FIG. 7.

Figure 8:
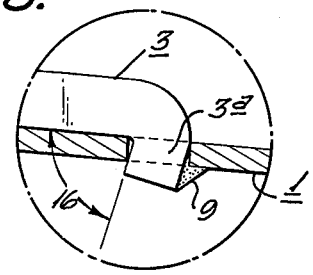
FIG. 8 is an enlarged view of the portion indicated in FIG. 5.

The end portion 3*a* of each radiating member or arm of the spider is bent downwardly, it being preferably bent to provide a bend angle 16 of slightly less than 90°. The bent end portions are fitted into slots 14 which are cut into the bottom wall of each leg element. The acutely angled end portion provides for the close interfitting and mechanical securing of the spider with the leg elements 1 as can be seen in detail in FIG. 8.

Figure 6:
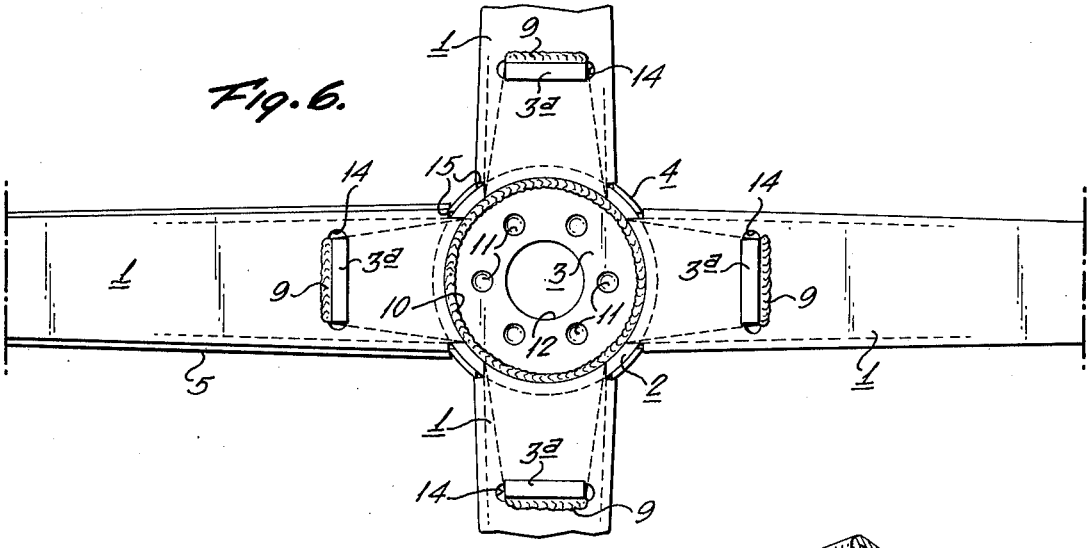
FIG. 6 is a fragmentary plan view of the bottom of the base of FIG. 1.

Although other securement means may be employed, in the preferred embodiment of the invention, the vertical element, the leg elements, and the spider element are secured by means of welding. One weld 10 secures the circumference of the annular portion of the spider to the interior of the cylindrical tube, and to the edge of the bottom wall of the leg elements. A second weld 9 secures the radiating spider arms to the leg elements at the point where the bent end portions extend through the slots in the leg elements. (See FIG. 6.) In addition, a third weld 8 secures the edge of the top wall of each leg element to the outer circumference of the cylindrical tube.

As should be apparent from the foregoing, the use of the spider element of the present invention has many advantages. The spider element 3 serves to increase the load capability of the base by reducing the tensile stresses normally arising in the lower part of the joints between the leg elements and the vertical column. Because of its heavy gauge and shape, the spider element is capable of withstanding high tension stresses and of preventing deformation of the lower part of the vertical element because much of the horizontal tensional load is removed from the vertical element.

The preferred form of spider element also provides means cooperating with the vertical post and height adjustment mechanism which is secured to the underside of the chair and which is not shown but is of well known construction. For this purpose, the spider includes a central opening 12 through which the chair post extends and detent notches or recesses 11 arranged around the opening 12 on the underside of the spider, in a circular pattern. The height adjustment mechanism comprises a vertical rod, not shown, which has a tip fitting within any one of the detent recesses. As will be understood by those skilled in the art, the tip moves into a recess when the chair is elevated or raised, thereby permitting vertical adjustment of the seat relative to the base.

The radiating leg elements 1 are preferably formed of relatively light sheet steel or other metal, bent to form a closed box-like cross-section. Preferably the sheet is joined lengthwise of the leg by a plurality of spot welds 7, although other means of securement may be employed. The joint should preferably be along the top wall of each leg as this wall is subjected to the least stress and the joint can be effectively masked by a wood, plastic or metal cap 5.

The tip of the leg element may be formed by any suitable means such as molding, extrusion or welding. Castor bushings 6 are typically provided and secured in aligned holes in the bottom and top wall of each leg by any suitable means such as spot welds.

Figure 3:
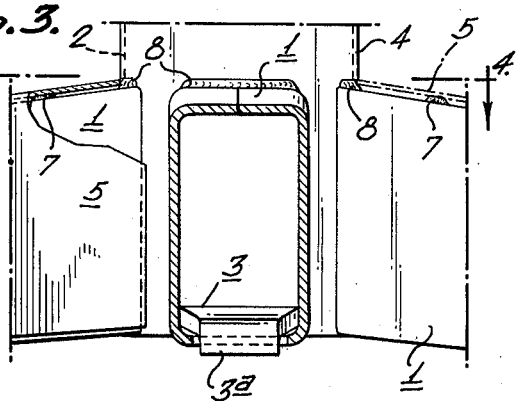
FIG. 3 is a sectional view taken on the line 3—3 of FIG. 1.
Figure 4:
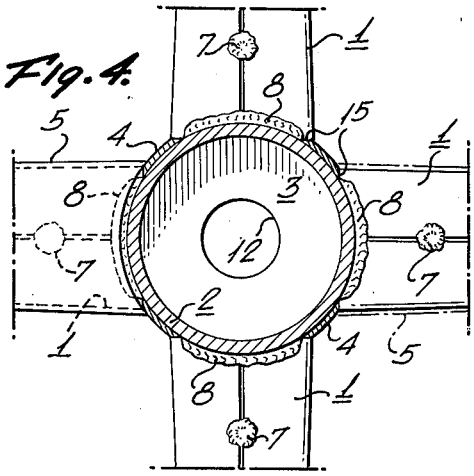
FIG. 4 is a sectional view taken on the line 4—4 of FIG. 3.
Figure 5:
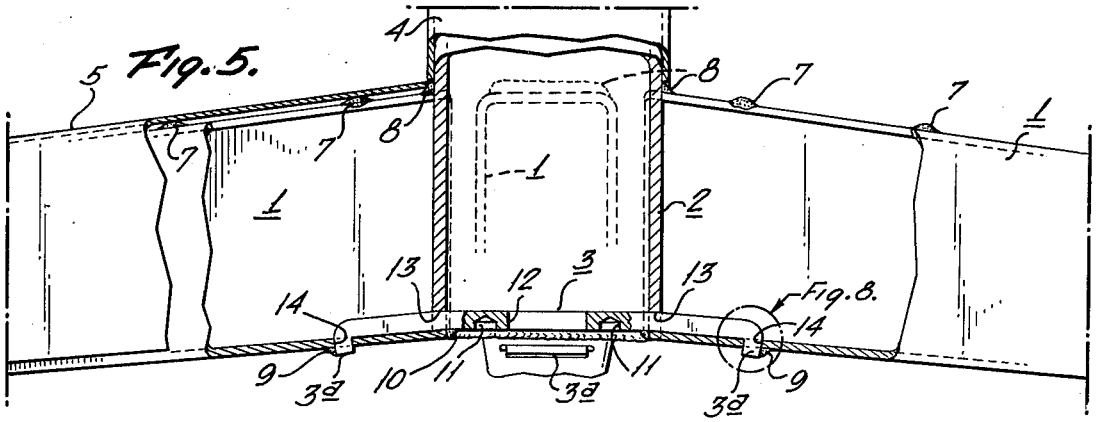
FIG. 5 is a sectional view taken on the line 5—5 of FIG. 1.

Preplated or other finished leg elements and vertical columns may be used because all weld locations are in unobstrusive locations or else are easily hidden from observation. As indicated above, a leg cap 5 may be secured on each leg element in order to mask the spot welds 7 and the welds 8 between the leg elements and the vertical column. If desired, the leg cap may extend down over both side walls of each leg element. A cylindrical sheath 4 may cover the cylindrical column 2. As shown in FIG. 3, the sheath has slots opening downwardly and being shaped to fit closely over the intermediate portions fitting between each leg element. Preferably, the legs are notched as shown at 15 in FIG. 7 so that the edges of sheath around the notches form neat, tight fitting joints with the legs.

It should be noted that a base of the present invention and having two leg elements is useful for supporting articles having a plurality of supporting means. For example, a table can be supported by two bases, each having two leg elements, or a series of chairs which are linked together can be supported by a plurality of bases each having two leg elements. In addition, a base having two leg elements can be used in conjunction with another type of support means. For example, an article such as a table can be supported at one end by attachment to a wall and at the other end by a base of the present invention having two leg elements.

The above described invention provides a base for chairs and the like which retains the aesthetic quality and appearance found in prior art bases while permitting the use of lighter gauge materials without sacrifice of strength and at substantial savings in labor costs. As a result of the basic structural design of the present development, it is also possible to utilize legs which have a relatively small width, while retaining overall strength of the type needed in conventional applications. This results in material savings and also allows flexibility in the choosing of aesthetically appealing and novel designs. Although open channel leg elements may be employed, the invention permits the use of closed channel or box-typed leg elements permitting the use of thinner gauge material while supplying high torsional strength. The use of a spider element for connecting the bottoms of the legs to the column support provides a means for carrying much of the load hitherto carried by less consistent weld joints. This feature of the invention substantially reduces the amount of welding required, reduces the likelihood of joint failure, and makes possible the use of preplated or prefinished parts.

I claim:

1. A base for furniture and the like comprising; a hollow central vertical column, a plurality of elongated metal leg elements for supporting said column, said leg elements extending generally radially outwardly from said column and having spaced apart walls of relatively thin cross-section, a load-distributing spider mounted on said vertical column near the bottom thereof and having a center portion and arms radiating outwardly from the center portion and from the column, said center portion fitting within said hollow central vertical column and being welded to said column, means interconnecting said leg elements to said arms, and said arms welded to said leg elements at points adjacent the ends of the arms.

2. A chair base comprising a central vertical column, a plurality of hollow legs radiating from and abutting with said central column and including a top wall and a bottom wall, a load distributing element secured to said column having a central portion and arms extending radially from said column and extending interiorly of said leg elements for distributing loads from said column to said leg elements, and including a first weld for securing the base of said column to said central portion of the load-distributing element, a second weld for securing the tips of the arms to the bottom wall of said hollow legs and a third weld for securing the legs to the column at points where the top walls of the legs abut said column.

3. A base according to claim 2 wherein said bottom wall includes a slot therein, said arms of the load distributing element have tips on the end portions thereof, the tips of the arms of the load distributing element are positioned to fit within said slot, and said second weld is positioned between said tip on the end of said arm and the outer edge of said slot to provide distribution of stresses along the length of said leg.

4. A base for furniture and the like comprising a central vertical column, at least two leg elements for supporting said column, said leg elements having a bottom wall and extending generally radially outwardly from said column, a load-distributing spider mounted on said vertical column and having radiating arms, and a means for mounting said leg elements on said arms comprising a slot in the bottom wall of each leg element and a tip on the end of each arm, said tip being positioned to fit within the slot and to mechanically interconnect the arms and the leg elements, and a weld for securing the tips of each spider arm to the associated leg at points adjacent to said slots.

5. A base according to claim 4 wherein said leg elements are hollow and said spider arms extend radially inwardly of said leg elements with the tips extending downwardly through said slots.

6. A base for furniture or the like comprising a central vertical column, at least two metal leg elements each having a bottom wall, two side walls and a top wall, said walls being spaced apart and having relatively thin cross section, said leg elements abutting with and extending generally radially from said column, a load-distributing spider abutting with said column and having an annular center portion and radiating arms, a first weld securing said top wall of each leg element to said column, a second weld securing said column and a third weld securing said leg elements to said annular center and the bottom wall of said leg element to said arms, said top wall pressing against said column when downward loads are imposed upon said column.

7. A base according to claim 6 wherein said bottom wall includes a slot and said arm includes a tip on the end of each arm, said tips being positioned to fit within the slots to mechanically interconnect the arms and the leg elements, said third weld positioned between said tip on the end of said arm and the outer edge of said slot to provide distribution of stresses along the length of each leg.

8. A base according to claim 6 wherein said second weld is on the entire circumference of the bottom of said column.

9. A base for furniture and the like comprising; a central vertical column, a plurality of elongated metal leg elements for supporting said column, said leg elements abutting and extending generally radially outwardly from said column and having spaced-apart walls of relatively thin cross section, said walls including a bottom wall having a slot therein, a load distributing spider mounted on said vertical column near the bottom thereof and having arms radiating outwardly therefrom, each of said arms having a tip on the end thereof, each of said tips being positioned to fit within the slots to mechanically interconnect the arms and the leg elements.

10. A base according to claim 9 wherein said leg elements are hollow, wherein said spider arms extend radially inwardly of said leg elements with the tips extending downwardly through said slots and wherein said securement means comprises welds interconnecting the tips of the spider arms to the edges of the slots away from the column.

11. A base according to claim 10 wherein said column is cylindrical and includes notches at the bottom thereof shaped and spaced to provide for the close fitting of said radiating arms of said spider.

12. A base according to claim 10 wherein said tips are acutely angled relative to said arms.

13. A chair base comprising a central vertical column, a plurality of hollow legs abutting and radiating from said central column and having side walls with vertical corner edges, a load distributing element secured to said column having arms extending interiorly of said leg elements for distributing loads from said column to said leg elements, means for securing said load distributing element to said legs, a sheath for covering said vertical column, the bottom of said sheath being slotted, and the vertical corner edges of said leg elements being cut away to form grooves between the edges of the side walls and the vertical column, and the edges of the slots of the sheath are adapted to fit within the grooves.

* * * * *